United States Patent [19]

Miller

[11] 4,191,634

[45] Mar. 4, 1980

[54] OCTANE UPGRADING PROCESS FOR LIGHT PARAFFINS USING A COMBINATION OF TWO PALLADIUM-ZEOLITE CATALYSTS

[75] Inventor: Stephen J. Miller, Emeryville, Calif.

[73] Assignee: Chevron Research Company, San Francisco, Calif.

[21] Appl. No.: 947,793

[22] Filed: Oct. 2, 1978

[51] Int. Cl.[2] ..... C10G 35/08

[52] U.S. Cl. ..... 208/65; 208/138

[58] Field of Search ..... 208/63, 64, 65, 138

[56] References Cited

U.S. PATENT DOCUMENTS

| | | | |
|---|---|---|---|
| 2,905,619 | 9/1959 | Sutherland | 208/64 |
| 3,293,192 | 12/1966 | Maher et al. | 423/329 |
| 3,597,349 | 8/1971 | Bertolacini et al. | 208/111 |
| 3,702,886 | 11/1972 | Argauer | 423/328 |
| 3,770,614 | 11/1973 | Graven | 208/62 |
| 3,781,199 | 12/1973 | Ward | 208/111 |

*Primary Examiner*—C. Davis

*Attorney, Agent, or Firm*—D. A. Newell; D. L. Hagmann; W. D. Reese

[57] ABSTRACT

The research octane of a light paraffinic hydrocarbon feed is effectively increased by consecutively contacting the feed under hydrocarbon conversion conditions with a palladium-HY-zeolite-alumina catalyst and then with a palladium-HZSM-5-zeolite-alumina catalyst.

7 Claims, No Drawings

OCTANE UPGRADING PROCESS FOR LIGHT PARAFFINS USING A COMBINATION OF TWO PALLADIUM-ZEOLITE CATALYSTS

BACKGROUND OF THE INVENTION

This invention is concerned with a process for upgrading the octane of low-boiling paraffinic hydrocarbons.

Low-boiling, for example in the range 25° C. to 70° C., paraffinic hydrocarbons are a significant component of gasoline pools obtained by processing crude oils. These hydrocarbons are normally deficient in terms of octane-number quality. In a typical refining of 50,000 barrels of crude oil, as much as 9000 barrels of low-boiling product may be produced. Common practice, despite the octane deficiency of this material, has been to include it in the gasoline pool and to make up the octane deficiency by use of lead-containing octane-improving additives. For environmental protection reasons, the addition of these additives to gasoline must be drastically limited or prohibited. Consequently, the refiner faces a serious need for an effective means for upgrading the octane number of the low-boiling hydrocarbon fraction or components of his gasoline pool.

Processes for upgrading the octane number of low-boiling hydrocarbons are known, for example see U.S. Pat. Nos. 2,905,619 and 3,770,614. Briefly, such processes suffer from disadvantages, including requirements for numerous fractionating steps, recycle streams, and processing stages; n-paraffin elimination (a yield loss) by a sacrificial cracking (shape-selective cracking) of n-paraffins to relatively low-value non-gasoline light gas by-products, and the like. A further notable and undesirable disadvantage is the usual inclusion of the $C_6$ paraffinic hydrocarbon component in feeds upgraded by conventional reforming operations. While this component may be modestly upgraded through some isomerization in a reforming stage, little, or only a minor portion, of it is converted to aromatic hydrocarbons. Consequently, the inclusion of $C_6$ paraffin in a reformer feed actually represents a substantial reduction in the efficiency of costly catalyst and reactor facilities.

An object of the present invention, in terms of yield-octane advantages, is to provide a process wherein the low-octane paraffinic hydrocarbon components or fraction of a gasoline pool are effectively upgraded.

A further aspect of this invention is to provide a process for upgrading a gasoline pool wherein $C_6$ paraffinic hydrocarbons are upgraded in a process stage other than in a reformer.

Other objects and advantages of this invention will become more apparent from the discussion and examples hereinafter expressed.

SUMMARY OF THE INVENTION

A process is provided for upgrading a paraffinic hydrocarbon feed (a) boiling in the range of from about 25° to 70° C., (b) containing at least 25 volume percent of a $C_5$ component and (c) having a research octane number below about 65, wherein the octane number of the feed is effectively increased by consecutively contacting the feed with a first and second fixed-bed catalyst, the contacting being under conditions including (1) a temperature in the range of from about 250° to 315° C.; (2) a pressure in the range of from about 20 to 54 atmospheres gauge; (3) a hydrogen gas to hydrocarbon mol ratio in the range of from about 3–8 to 1, respectively; and (4) a composite liquid hourly space velocity, V/V/hr, in the range of from about 0.5 to 2. The first catalyst consists essentially of palladium, ultra-stable H-Y zeolite and alumina, and the second catalyst consists essentially of palladium, H-ZSM5-type zeolite and alumina. Each of the two kinds of catalyst contains, for each 100 parts by weight, an amount of palladium in the range of from about 0.1 to 1 part, an amount of alumina and the respective zeolite H-Y or H-ZSM5 zeolite, in the range of from about 25 to 75 parts. The recovered hydrocarbon effluent, relative to the feed, has an improved research octane number, and the improvement is achieved with but a modest loss of feed to less desirable by-product hydrocarbons, i.e., the conversion is effectively achieved.

EMBODIMENT OF THE INVENTION

In a preferred embodiment a hydrofined $C_5$–$C_6$ straight-run Arabian naphtha feed is upgraded by contact thereof with a layered catalyst bed (see description below) under conditions including (1) a temperature of about 271° C., (2) a pressure of about 27.2 atmospheres gauge, (3) a hydrogen gas to hydrocarbon mol ratio of about 5, and (4) a liquid hourly space velocity, V/V/hr, of about 0.7.

A typical feed and representative results achieved are listed in the table below.

| | Feed | Product |
|---|---|---|
| $C_2$ | 0 | 0.04 |
| $C_3$ | 0 | 2.7 |
| $C_4$ | 0.5 | 8.1 |
| $C_5$ | 24.8 | 27.8 |
| $C_6$ | 60.1 | 59.7 |
| $C_7$ | 12.8 | 1.6 |
| $C_8$ | 1.8 | 0 |
| $C_5$+ | 99.5 | 89.5 |
| R.O.N. | 64.9 | 76.0 |
| M.O.N. | 63.9 | 74.4 |
| $C_6$ Paraffin R.O.N. | 55.5 | 71.7 |
| $C_5$ Paraffin R.O.N. | 72.1 | 80.4 |

The upstream portion (first layer or bed) of the layered catalyst bed amounts to two-thirds of the volume of the bed, the balance being the second bed or layer. Each of the catalysts is a composite containing equal portions by weight of a zeolite component and an alumina matrix component and also containing about 0.5 weight percent of palladium disposed upon the zeolite. The zeolite in the catalyst of the first layer is ultrastable Y-zeolite in the hydrogen form. That in the catalyst of the second layer is ZSM-5 zeolite in the hydrogen form.

As a result of the contacting of the feed with the layered-bed catalyst, a minor amount, for example about 10%, of the product is $C_3$–$C_4$ by-product hydrocarbons. These are separated from the desired upgraded $C_5$ product by conventional means, for example by fractional distillation, flashing or the like. From the above results, it is seen that the octane number of the product is substantially improved over that of the feed.

PROCESS FEEDS

Hydrocarbon mixtures satisfactory for use as feeds for the process herein comprise paraffinic hydrocarbons boiling in the range of from about 25° to 70° C. which have research octane numbers below about 65 (ASTM Method). These mixtures, in general, are relatively undesirable as fractions of a gasoline pool or as gasoline blending stock. They normally contain a $C_5$-component and a $C_6$-component and may contain minor amounts of $C_4$ and $C_7$ hydrocarbons and of olefinic hydrocarbons boiling in the aforementioned range. Previously hydrofined feeds, however, usually contain little or none of the olefins. For reasons of practicality, the feed should be substantially, e.g., at least 95 mol percent, paraffins, and contain at least 25 volume percent of $C_5$ hydrocarbons. Satisfactory feeds usually contain an amount of $C_5$ hydrocarbons in 25 to 75 volume percent range, although this content may exceed 75 volume percent and yet achieve an advantageous result.

Representative process feeds include the 25° to 70° C.-boiling fraction of light straight-run gasoline or of cracked gasoline as well as paraffinic composites of individual cuts of $C_5$- and $C_6$-forecuts recovered in refining petroleum and/or synthetic crude oils such as tar sand and shale oils and the like and combining and/or fractionating the resulting blends. These feeds may or may not have been subjected to hydrofining treatment(s) for the removal of sulfur- and/or nitrogen-containing impurities normally present in petroleum and/or syncrude fractions.

PROCESS CONDITIONS

The process conditions satisfactory for use herein include:

| | Broad Range | Preferred Range |
|---|---|---|
| Temperature, ° C. | 245–315 | 250–290 |
| Pressure, Atm. gauge | 20–54 | 25–31 |
| $N_2$ to Hydrocarbon Mol Ratio | 3–8 to 1 | 5 to 1 |
| LHSV, V/V/hr | 0.5 to 2 | 1 to 1.5 |

The use of the temperatures in the upper part of the above temperature range is normally desirable where the $C_5$ content of the feed is also in the upper portion of the feed range. As the catalyst ages, the use of higher temperatures will, of course, also be desirable.

THE CATALYST

Catalysts satisfactory for use herein are porous composites of a substantially alumina matrix and an ultrastable Y or a ZSM-5 zeolite. The matrix may also contain a minor amount of the other refractory oxides conventionally used as catalyst supports and which, like alumina, or when present in a minor amount, do not materially increase hydrocarbon cracking activity of the matrix per se, such as magnesia, trace yet alumina-stabilizing amounts of silica, calcium oxide and the like minor diluents, that is, the matrix herein consists essentially of alumina.

The amount of matrix material desirably present in the catalysts herein varies, and, in general, should be an amount sufficient to effectively bind the zeolite component, which is generally sized in the micron size range, into macrosized particles sized for use in a conventional fixed-bed reactor stage, for example in the diameter range of from about 0.008 to 0.06 mm. The catalysts should contain at least 25 weight percent of the zeolite component. Good results are, in general, achieved when the catalysts contain an amount of each component, matrix and zeolite, which is in the range of from about 25 to 75 weight percent, preferably 50/50.

The palladium component of the catalyst should constitute at least 0.05 weight percent thereof. Good results are obtained when the palladium content is in the range of from about 0.1 to 1 weight percent. Catalysts containing larger amounts of palladium are satisfactory in terms of the desired conversion; however, in terms of cost-to-advantage ratio, there is little or no incentive to increase the palladium content of the catalysts herein above about the 1% level. The palladium may be introduced into the catalyst by any suitable and conventional means, including impregnation, cation exchange, precipitation in finely divided form in the matrix, and the like. Preferably, the palladium is present, in the main, in the zeolite component, having been introduced therein by conventional cation exchanging means using a water-soluble salt and the zeolite in its known ammonium and/or hydrogen form.

The zeolites required herein are well known in the art. The ultrastable H-Y crystalline aluminosilicate zeolite and the preparation thereof are described in U.S. Pat. No. 3,293,192 (P. K. Maher et al) as well as in U.S. Pat. Nos. 3,597,349 (R. J. Bertolacini) and 3,781,199 (J. W. Ward). Particular identifying parameters thereof, in addition to its fajuasite classification, are its unit cell constant below about 24.50 and its low sodium content (calculated as sodium oxide) below about 1 weight percent.

The ZSM-5-type crystalline aluminosilicates are required for use as catalyst components for the downstream catalyst bed or layer. These catalysts are known in the art and per se are not considered to be inventive. This type of zeolite is exemplified by ZSM-5, ZSM-11 and ZSM-35 and other similar materials. U.S. Pat. Nos. 3,702,886, R. J. Argauer et al, and 3,770,614, R. G. Graven, describe the ZSM-5 preparation, composition and related information, the entire contents of which are incorporated herein by reference. The H-ZSM-5 form of the ZSM-5-type zeolite required herein is obtained by conventional base- and/or ion-exchange methods routinely employed in the zeolite art, including customary zeolite drying and calcining steps. Preferably, the ZSM-5 zeolites herein have minimal sodium contents, for example by weight, less than about 100 ppm, although ZSM-5 zeolites having a larger sodium content exhibit relatively useful catalytic activity for present purposes. In any case, in order that the zeolite catalyst exhibit a satisfactory catalyst life (the period between startup and the first regeneration or between successive regenerations), the zeolite per se must have a silica-to-alumina mol ratio in the range of from about 40 to 160, preferably 60 to 140, and more preferably 90 to 105.

In connection with the silica-alumina ratio of the ZSM-5 herein, a series of zeolites in the H-form and with varying ratios of silica-alumina were prepared and tested. The data obtained demonstrated that for a satisfactory catalyst life, the silica-to-alumina mol ratio of the ZSM-5 zeolite should be in the range of from about 40 to 160, and that for reasonably optimum results, it must be about 95 to 105.

The two zeolite-containing catalysts may be contained in separate or the same reactor. When present in the same reactor/reaction zone, they may be in a contiguous layer in a single bed, in separate layers, each of which is contiguous with an intervening layer of inert particles, for example alumina, or in separate beds separated by a void zone. In every case, the catalyst containing the Y-zeolite must be situated on the upstream side of the other catalyst. The contiguous layered-bed system is preferred for reasons of cost and convenience.

The catalysts required herein may be prepared by any suitable method, preferably by the known method of ion-exchanging (loading) the desired amount of palladium into the zeolite in finely divided form and then efficiently intermixing the loaded zeolite with sufficient aluminous hydrogel to provide, on a dry basis, the desired composite. The resulting mixture is then shaped, usually by extruding, dried and calcined. In an alternate mode, a dried and calcined composite of zeolite and matrix material is prepared. The composite is then impregnated with a suitable solution of a palladium salt, for example an aqueous solution of tetraamine palladium chloride. Drying and calcining under known conditions completes the preparation.

What is claimed is:

1. A process for upgrading a hydrocarbon paraffinic feed (a) boiling in the range of about from 25° C. to 70° C., (b) containing at least about 25 volume percent of a $C_5$ component and (c) having a research octane number below about 65, which comprises:

effectively increasing said octane number by consecutively contacting said feed with a first fixed bed catalyst and second fixed-bed catalyst, said contacting being under hydrocarbon conversion conditions, including:

(1) a temperature in the range of from about 250° to 315° C.;

(2) a pressure in the range of from about 20 to 54 atmospheres gauge;

(3) a hydrogen gas to hydrocarbon mol ratio in the range of from about 3–8 to 1; and (4) a composite liquid hourly space velocity in the range of from about 0.5 to 2;

said first catalyst consisting essentially of palladium, ultrastable H-Y zeolite and alumina, said second catalyst consisting essentially of palladium, HZSM-5-type zeolite and alumina; and said catalysts each containing, for each 100 parts by weight thereof (a) an amount of palladium in the range of from about 0.1 to 1 part and (b) an amount of alumina and the respective zeolite in the range of from about 25 to 75 parts, and said ZSM-5-type zeolite having a silica-to-alumina ratio in the range of from about 40 to 160; and recovering the resulting hydrocarbon effluent having, relative to said feed, an improved research octane number.

2. A process as in claim 1 wherein each of said catalysts contains about 0.5 weight percent of palladium, said feed is a $C_5$–$C_6$ straight-run fraction, and said conditions include a temperature of about 271° C., a pressure of about 27 atmospheres gauge, a liquid hourly space velocity, V/V/Hr, of about 0.7, and a hydrogen gas-to-hydrocarbon mol ratio of about 5.

3. A process as in claim 1 wherein said feed is a hydrofined hydrocarbon mixture.

4. A process as in claim 1 wherein said feed is a light straight-run gasoline.

5. A process as in claim 1 wherein said temperature is in the range of from about 250°–290° C., said pressure is in the range of from about 25 to 31 atmospheres gauge, said hydrogen gas-to-hydrocarbon mol ratio is about 5 to 1, and said space velocity is in the range of from about 1 to 1.5.

6. A process as in claim 1 wherein the weight ratio of matrix to zeolite of said catalysts is about 50/50.

7. A process as in claim 1 wherein said ZSM-5-type zeolite has a silica-to-alumina mol ratio in the range of from about 90 to 105.

* * * * *